United States Patent [19]

Moeller et al.

[11] Patent Number: 4,898,016

[45] Date of Patent: Feb. 6, 1990

[54] IN-ROOF FLANGING FIXTURE AND PROCESS

[75] Inventors: Jon D. Moeller, Farmington Hills; Donald J. Old, Union Lake, both of Mich.

[73] Assignee: ASC Incorporated, Southgate, Mich.

[21] Appl. No.: 240,009

[22] Filed: Sep. 2, 1988

[51] Int. Cl.[4] ..... B21D 11/18; B21D 37/16

[52] U.S. Cl. ..... 72/342; 72/375; 72/414; 29/401.1

[58] Field of Search ..... 72/69, 74, 125, 210, 72/342, 375, 379, 414, 415, 412; 29/401.1, 402.19, 402.21, 468

[56] References Cited

U.S. PATENT DOCUMENTS

| | | | |
|---|---|---|---|
| 1,656,277 | 1/1928 | Haak et al. | 72/126 |
| 1,855,978 | 4/1932 | Malone | 72/125 |
| 1,979,472 | 11/1934 | Kelly | 72/415 |
| 2,193,050 | 3/1940 | Wiest | 72/125 |
| 3,289,454 | 12/1966 | Chandler | 72/414 |
| 4,081,985 | 4/1978 | Rothenberger | 72/125 |
| 4,553,307 | 11/1985 | Kaltz et al. | 29/401.1 |

FOREIGN PATENT DOCUMENTS

| | | | |
|---|---|---|---|
| 203619 | 9/1987 | Japan | 72/342 |
| 5493 | 12/1880 | United Kingdom | 72/125 |
| 361069 | 11/1931 | United Kingdom | 72/342 |

*Primary Examiner*—Robert L. Spruill
*Attorney, Agent, or Firm*—Arnold S. Weintraub

[57] ABSTRACT

A flanging fixture, and a method of attaching the fixture and performing flanging operation on a pointed metal surface of a vehicle, surrounding an aperture. The flanging fixture is positioned on the painted metal surface surrounding the aperture. The fixture is secured to the vehicle surface and a source of heat is applied to the vehicle surface. The vehicle surface is heated to an optimum temperature, and the offsetting tool is applied to the metal surface. The offsetting tool is worked around the perimeter of the aperture to perform the flanging operation on the painted metal surface resulting in a formed ledge without damaging the painted surface.

17 Claims, 4 Drawing Sheets

IN-ROOF FLANGING FIXTURE AND PROCESS

BACKGROUND OF THE INVENTION

1. Field of the Invention

The present invention concerns a flanging fixture for forming a ledge in an opening in a vehicle and a process for performing the fixturing and flanging operation on a painted metal surface surrounding the opening in a vehicle. More particularly, the present invention concerns means and methods for forming a ledge about a sunroof opening or aperture in a vehicle.

2. Prior Art

The formation of a flanged or offset edge to form a ledge or surface for receipt of a sunroof is well known in the art. Heretofore, the methods used involve either (a) an offsetting process to the vehicle surface surrounding the sunroof aperture or (b) a welding process, to weld a pre-formed ledge into the vehicle roof aperture area. Earlier methods of offsetting a roof surface surrounding an aperture required applying an air tool, such as a pneumatic tool, to the periphery of the vehicle surface surrounding the aperture, to form an offset surface for receipt of a sunroof. Either method, welding or offsetting, however, requires the roof or offset surface to be sanded and repainted. This, of course, leads to added labor, expense, chance of error and irregularly painted surfaces.

The present invention, as will be detailed, teaches a flanging device and method of forming a flange or offset surface which eliminates these expensive, time consuming steps.

SUMMARY OF THE INVENTION

The present invention, provides a fixture which heats the vehicle surface and provides a template for an offsetting process. The fixture includes swing blocks for locating the fixture on a vehicle surface, as well as means, such as an air clamp, for removably securing the fixture on a vehicle surface, and a tool, such as an air hammer for forming the flange or ledge as well as means for heating the vehicle surface.

The present invention, also, provides a process for performing a fixturing and flanging operation on a painted metal surface surrounding an aperture which comprises:

placing a flanging fixture on a painted metal surface of a vehicle surrounding an aperture on a vehicle roof;

positioning the fixture by means of locating swing blocks;

activating an air clamp system on the fixture to securely attach the fixture to the vehicle surface;

heating the entire periphery of the metal surrounding the opening;

locating a hand held offset tool on the fixture;

applying the tool to the heated metal surface around the periphery of the vehicle aperture; and forming a ledge from the heated metal about the opening.

For a more complete understanding of the present invention reference is made to the following detailed description and accompanying drawing. In the drawing like reference characters refer to like parts throughout the several views, in which:

DESCRIPTION OF THE PREFERRED EMBODIMENTS

Figure 1:
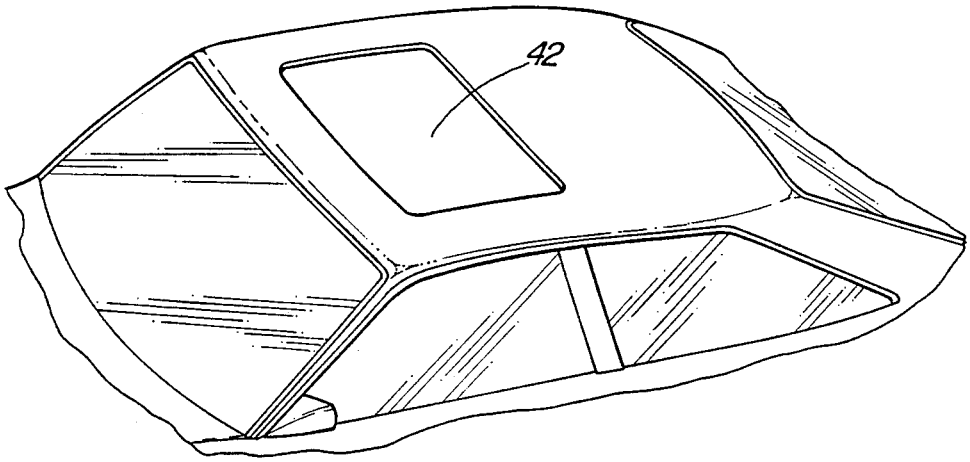
FIG. 1 shows a formed aperture in the vehicle surface to which the fixture hereof is applied.

Now and with reference to the drawing, and in particular to FIGS. 1–6, there is depicted therein a method of forming an offset ledge around the perimeter of an aperture formed in a vehicle surface. The method hereof, generally, comprises:

placing a flanging fixture on the painted metal surface of a vehicle surrounding an aperture in a vehicle roof;

securing the flanging fixture to a vehicle surface;

heating the entire periphery of the metal surrounding the aperture;

locating an offsetting tool on the fixture;

applying the tool to the heated metal surface around the periphery of the vehicle aperture to form a ledge from the heated metal about the opening.

Depicted in FIGS. 2–6 is an apparatus or system for carrying out the present process. The apparatus hereof, generally, includes a flanging fixture, denoted as 10 for performing the flanging operation on a painted metal vehicle surface 41 surrounding the perimeter of an aperture 42 to form a downwardly extending ledge 44 (FIG. 6), for receipt of a closure panel (not shown).

Figure 2:
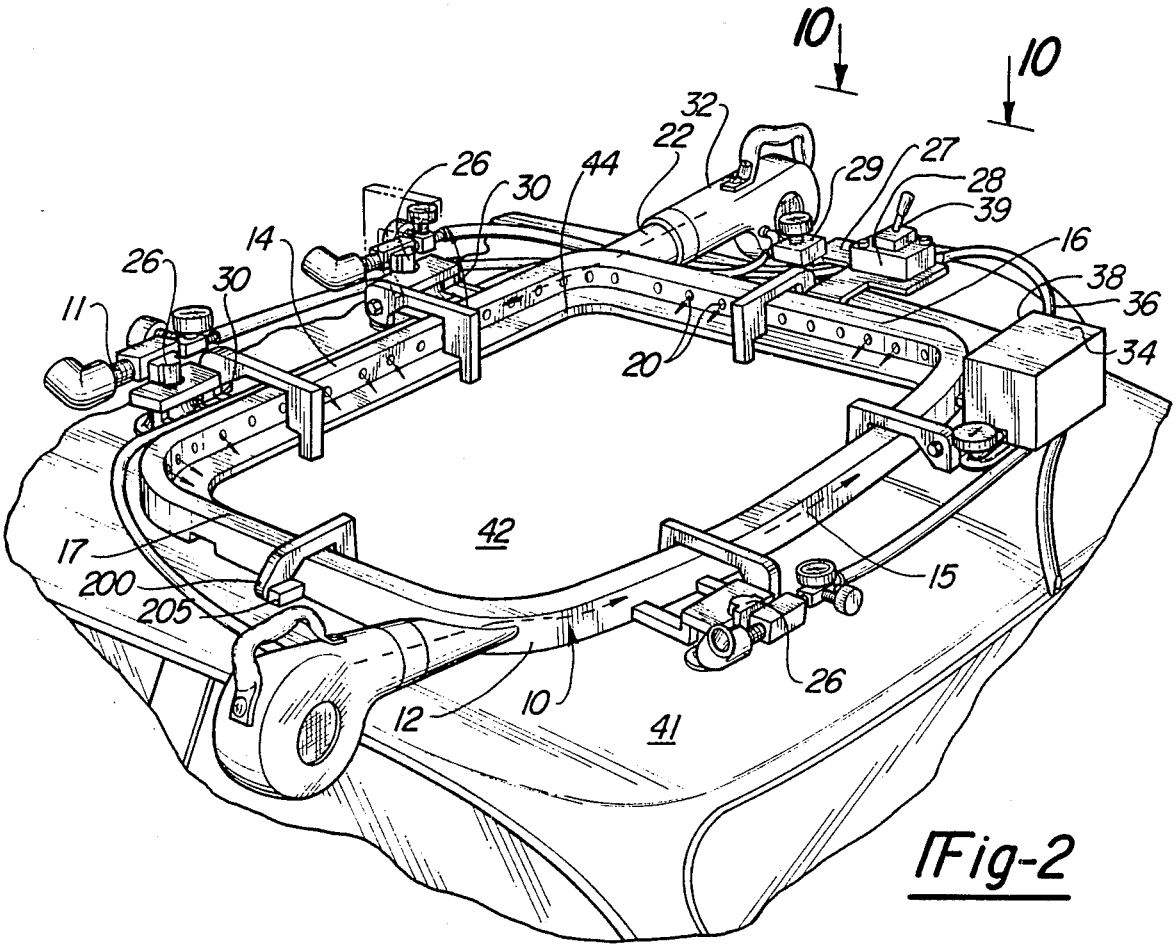
FIG. 2 shows the fixture hereof in place on the vehicle surface.

As shown in FIG. 2, the flanging fixture 10 comprises a unitary, tubular frame 12 of, generally, rectangular shape which fastens to the vehicle roof about the perimeter of the roof aperture 42. The frame 12 comprises a pair of parallel, spaced apart elongated side members 14, 15 and a pair of parallel, spaced apart shorter side members 16, 17. Preferably, the frame 12 is constructed of a lightweight material, such as aluminum.

Attached to the flanging fixture 10 are a plurality of locating swing blocks, as at 18, for positioning the fixture around the aperture. The locating swing blocks are of U-shaped configuration and are pivotally connected as at 205 to each side of the rectangular frame 14, 15, 16 and 17.

At least one locating swing block attaches to each of the elongated side members 14, 15 and to each of the two shorter side members 16, 17 of the rectangular frame.

Figure 3:
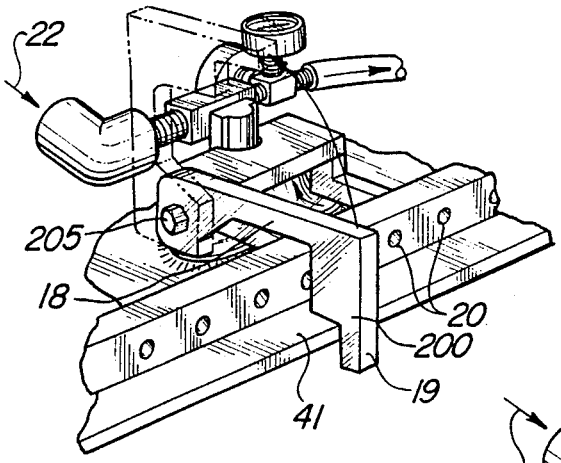
FIG. 3 shows locating swing blocks and an air clamp system sued in the practice hereof.

As shown in FIG. 3, the locating blocks are, generally, planar members having a main body portion 200 which seats on the roof surface 41 and a depending portion 19. The blocks pivot from a raised position to a position wherein one depending portion, or side 19, of each of the U-shaped blocks 18, overhangs the vehicle sruface 41, surrounding the peripheral edge of the aperture of the vehicle. Preferably, the blocks are constructed of a lightweight material such as polyethylene.

Figure 4:
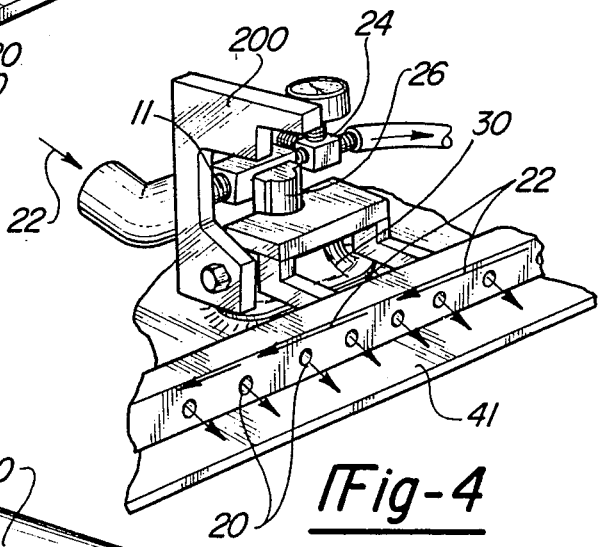
FIG. 4 is a broken, perspective view of a flanging fixture with an attached offsetting tool.

As shown in FIG. 4, the tubular frame 10 houses a system of vents 20 and ducts 22 for the circulation of air through the flanging fixture, for operating an air clamp system 24 and to supply heated air for heating the vehicle surface 41.

Figure 9:
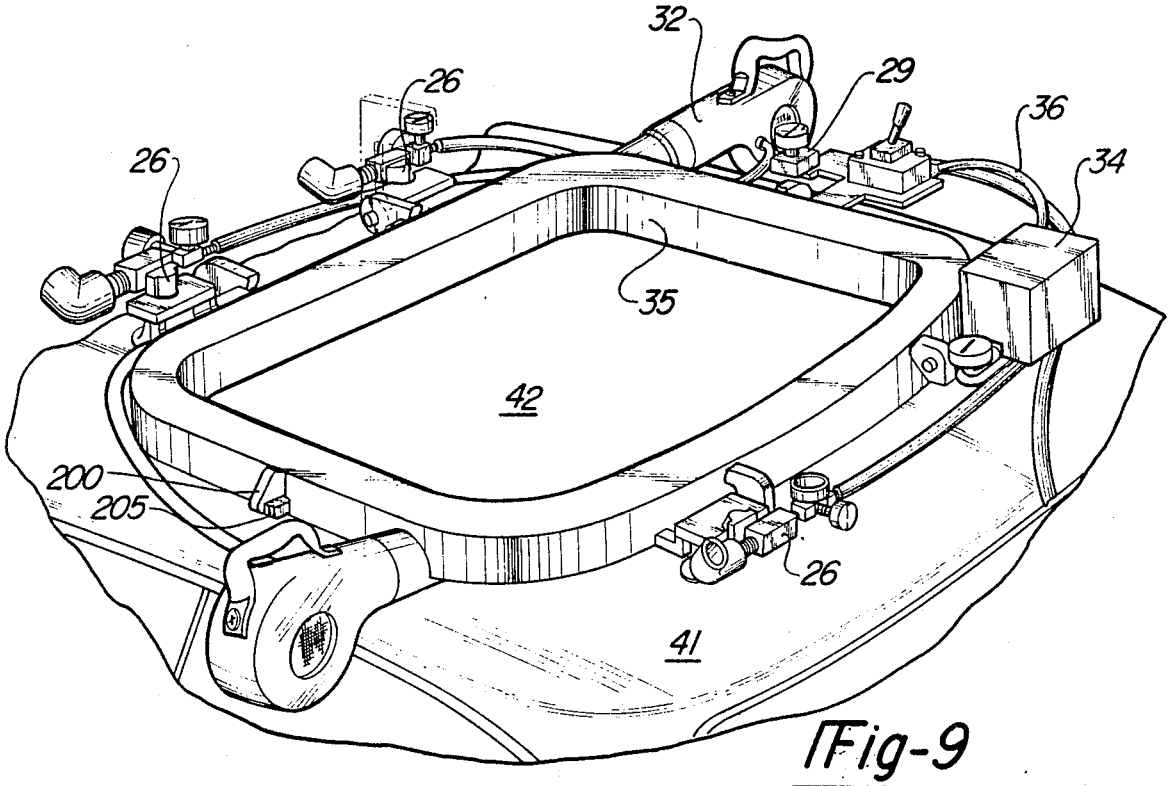
FIG. 9 shows the heat deflector shield in place.
Figure 10:
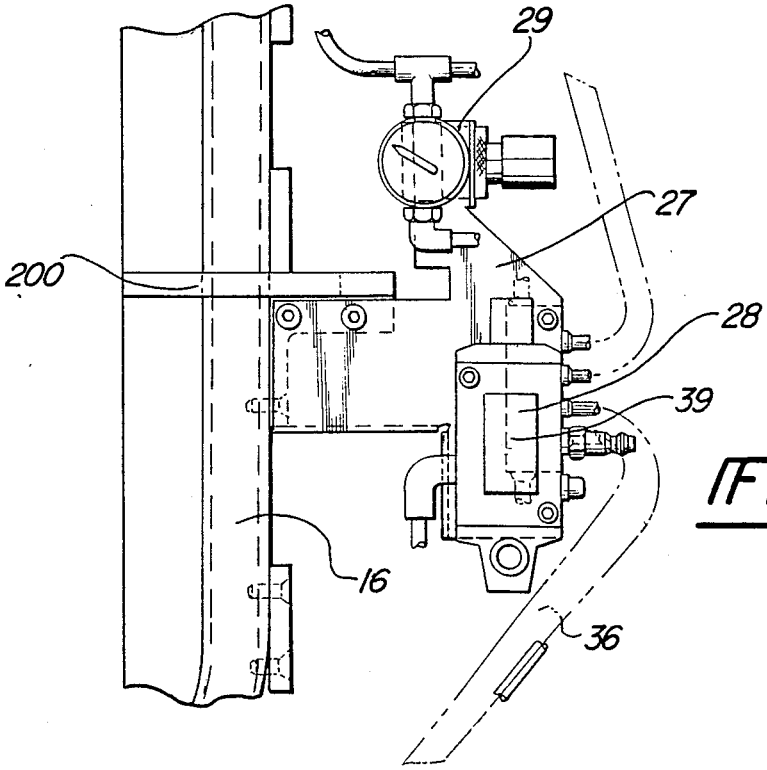
FIG. 10 shows a detailed view of the electrical control, and air control features of the fixture.

As shown in FIGS. 2, 4, 9 and 10 the air clamp system 24 is operably connected to the flanging fixture 10 and is operated by air circulating through the fixture 10. The air clamp system 24 is controlled by an on-off toggle switch 39 and comprises a vacuum-suction system which is activated when air flows through a venturi 26, causing a pressure differential and creating a suction system. As shown in FIG. 10, the vacuum supply system is regulated by a pneumatic air control valve 28, polymatic manifold 27, and master pneumatic regulator 29. As shown in FIG. 4, a suction adhering means 30 is operably connected to the vacuum supply system and contacts the vehicle surface 41, thereby securing the fixture to the vehicle surface. The noise created by the vacuum system is muffled by a silencer 11.

As shown in FIG. 9, once the fixture 10 is in place and before heating the surface, a heat deflector shield 35 comprising a lightweight, heat reflective material formed to cover the flanging fixture 10, encompassing the entire periphery of the fixture, is placed over the fixture. The deflector shield facilitates faster, more efficient heating of the vehicle surface.

As shown in FIG. 2, the flanging fixture is used to heat the vehicle surface 41 to a temperature of between about 170° F. and 210° F. The surface is heated by air originating from a blower 32 operably connected to the fixture 10 and directed through a heat sending unit 34 where it is heated and directed onto the vehicle surface 41 via vents 20 and ducts 22. The heat sending unit 34 comprises an electrical heating coil, whereby air directed through the heat sending unit 34 is heated to the desired temperature. A temperature measuring means such as a thermocouple 36 is installed in the fixture 10 and is operably connected to the vehicle surface 41. A temperature display 38 is operably connected to the thermocouple 36 to monitor the temperature of the vehicle surface. An off/on/heat control switch and electrical control box connected to the heat pending unit, control the electrical power to the blower and heat sending unit. When the roof skin reaches the desired temperature the blower unit 32 is switched off, the deflector shield 35 is removed and a hand held panel offset tool 50 is applied to the roof skin. Heating makes the vehicle surface malleable, and subsequent offsetting of the heated surface a formed ledge without damaging the painted vehicle surface.

Figure 5:
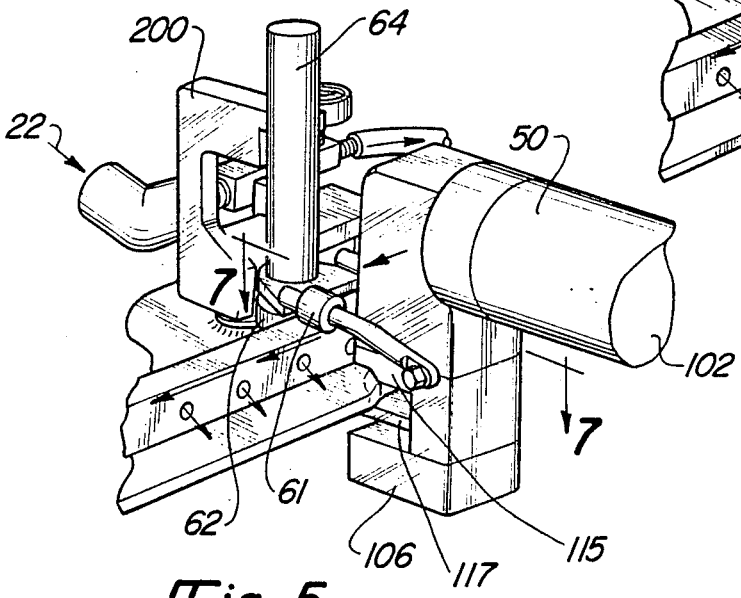
FIG. 5 shows the pneumatic air hammer applied to the flanging mixture and vehicle surface.
Figure 7:
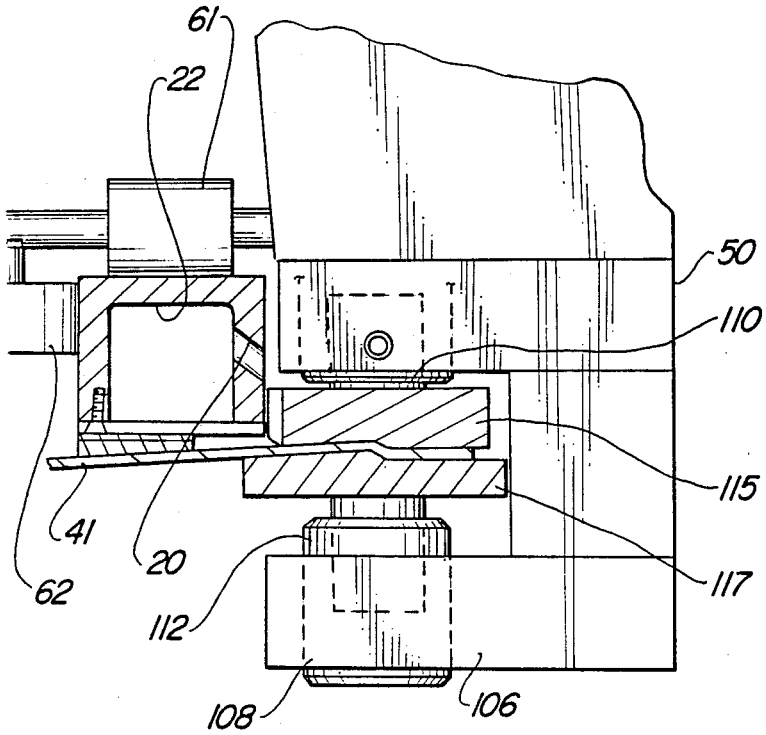
FIG. 7 shows a sectional view of the flanging fixture and pneumatic tool.
Figure 8:
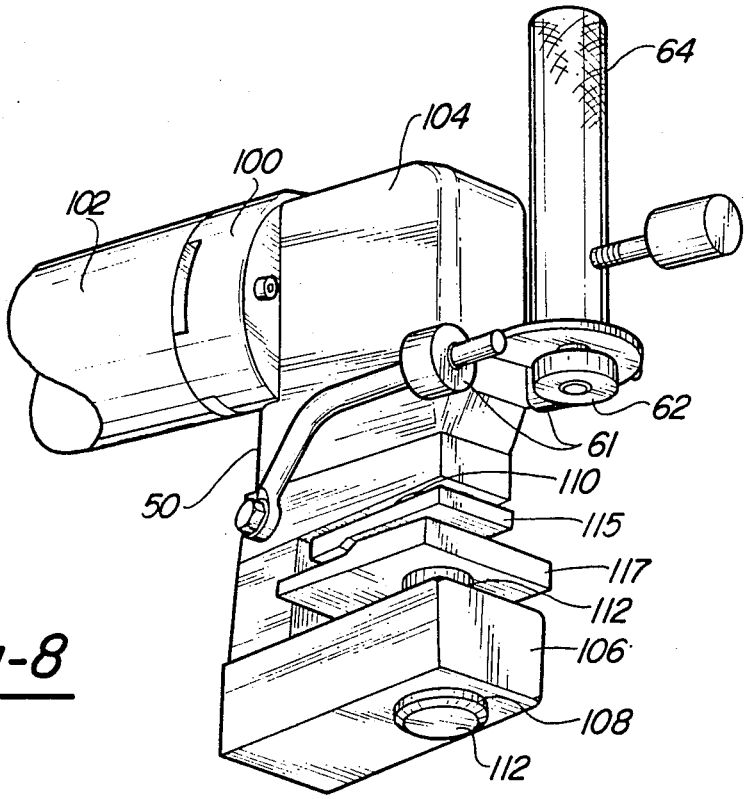
FIG. 8 shows the pneumatic tool.

The offset or offsetting tool 50, as shown in FIGS. 5, 7 and 8 generally comprises an electrical motor 100 encased within a housing 102 operably connected to the body 104 of the tool 50. Alternatively, the tool may be pneumatically operated (not shown). The body 104 of the tool comprises a rectangular base 106 having a cylindrical chamber 108 for receipt of upper and lower shafts 110, 112. The shafts are connected to upper and lower offset dyes, shown as 115 and 117. The shafts are capable of vibration and movement of the intensity necessary to cause at least one dye to impact and form an offset surface or ledge. Rollers 61 and 62 and a handle 64 attach to the body of the tool for guiding and directing the tool.

The flanging process is carried out as follows: the flanging fixture 10 is placed on the vehicle surface framing the perimeter of the aperture 42. The locating swing blocks 18 are pivoted to a position wherein one side 19 of the U-shaped blocks overhangs the perimeter of the aperture 42. When all of the locating blocks are in operating position, the air clamp system 24 is activated by turning the toggle switch 39 to the "on" position thereby activating the air supply to the venturi; a vacuum is created by air flowing through the venturi causing the suction adhering means 30 to securely attach the fixture to the vehicle surface 41. The locating blocks are removed at this time and the heat deflector shield 35 is placed over the fixture to encompass the entire periphery of the fixture.

The secured flanging fixture 10 is ready to be used to heat the vehicle surface. The blower 32, and heat sending unit 34, which supply heated air for heating the vehicle surface are activated by turning the control switch 39 to the on/heat position. The theromocouple 36 is operably connected to the vehicle surface and a digital temperature display 38. The temperature of the vehicle surface is optimally maintained at between 170° F. and 210° F. The roof surface 41 is heated to the optimum temperature by means of hot air flowing through the flanging fixture, as hereinbefore noted.

Once the roof surface reaches the optimum temperature the offsetting tool is applied to the surface and the offsetting procedure is commenced. The tool roller 61 contacts the flanging fixture ring 10, as shown in FIGS. 5 and 7. The rectangular base of the tool is applied to the metal surface. The motor 100 is activated and the tool is directed manually about the fixture by the handle, in either a clockwise or counterclockwise fashion until the tool is returned to its starting position. Once the entire panel has been offset, the offsetting tool is turned off and disengaged from the fixture. The control switch is then turned off and the fixture is removed from the roof surface.

Figure 6:
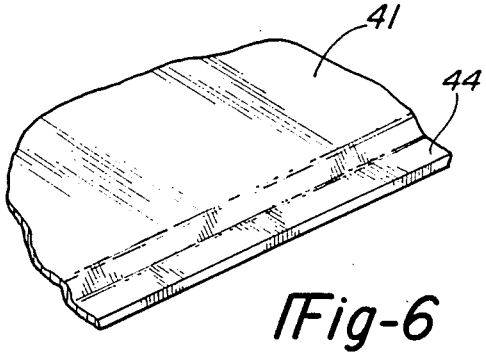
FIG. 6 shows the offset vehicle surface.

By employing the present device, it is possible to form a ledge as shown in FIG. 6, in a vehicle roof surface without the need for sanding and/or repainting the vehicle surface after formation of the ledge.

Having, thus, described the invention, what is claimed is:

1. A flanging fixture for heating and offsetting a peripheral edge of a vehicle surface surrounding an aperture to form a downwardly extending ledge for receipt of a closure panel, comprising:

a frame removably mountable onto a vehicle surface;

means for locating the fixture on a vehicle surface about an aperture;

a means for heating the vehicle surface about the periphery of the aperture;

means for removably securing the frame on a vehicle surface, and;

means for forming a ledge about the periphery of the aperture, said means being removably connected to the frame.

2. The fixture of claim 1 further comprising a system of vents and ducts framed within the frame for issuing heat to the surface about the aperture.

3. The fixture of claim 2 wherein the heating means comprises:

a blower motor and heat sending unit in fluid communication with the frame for issuing heat through the vents and ducts.

4. The fixture of claim 3 further comprising a means for measuring the temperature of the vehicle surface and a temperature display connected to the means for measuring the temperature of the vehicle surface.

5. The fixture of claim 1 wherein the means for locating comprises at least one locating swing block, the swing block comprising a main body portion which seats on a vehicle surface and a depending portion which projects into the aperture, and means for pivotally mounting the swing block to the frame.

6. The fixture of claim 1 further comprising a clamping system, having a suction adhering means operably connected thereto, for securing the frame to the vehicle, the clamping system defining the means for removably securing.

7. The fixture of claim 6 further comprising an air current system for operating the clamping system, having a pneumatic air control valve, poly-matic manifold, and master pneumatic regulator.

8. The fixture of claim 7 further comprising a silencer operably connected to the air current system.

9. The fixture of claim 7 wherein the air current system is operably connected to a silencer.

10. The fixture of claim 1 further comprising a heat deflector shield.

11. The fixture of claim 1, wherein the means for forming a ledge comprises an offsetting tool: the tool having at least one impact surface, the impact surface contacting the vehicle surface around the perimeter of the aperture; a lower base to support the impact surface; guiding means wherein the guiding means aligns with the frame to guide the tool; and means for powering the tool.

12. The offsetting tool of claim 11 wherein the impact surface is operably connected to an electrically driven cylinder.

13. The offsetting tool of claim 11 wherein the impact surface is operably connected to a pneumtically driven cylinder.

14. The offsetting tool of claim 11 wherein the guiding means comprises at least one roller and a handle.

15. The offsetting tool of claim 11 wherein the tool is powered by an electric motor.

16. A method of performing a flanging operation on a painted metal surface surrounding an aperture to form flanged surface, utilizing the offsetting tool as defined in claim 12, comprising the following steps:

(a) forming an aperture in a roof of a vehicle;
(b) affixing a flanging fixture to a vehicle roof surface about the aperture;
(c) heating the metal surface to an optimal temperature; and
(d) maintaining the optimal temperature of the metal; and
(e) supporting the offsetting tool on the flanging fixture;
(f) applying the offsetting tool to the heated metal surface to deform the metal surface to form a flanged surface;
(g) moving the tool in a continuous motion around the perimeter of the fixture to form a flanged surface, until the tool is returned to its beginning location.

17. The method of claim 16 wherein:

the metal is heated to a temperature of between about 170° F. and 210° F.

* * * * *